US005181742A

United States Patent [19]

Peng

[11] Patent Number: 5,181,742

[45] Date of Patent: Jan. 26, 1993

[54] COMBINATION NOTE AND ARTICLE SUPPORT DEVICE AND METHOD

[76] Inventor: Mike Peng, 6200 Edinger - #409, Huntington Beach, Calif. 92647

[21] Appl. No.: 829,931

[22] Filed: Feb. 3, 1992

[51] Int. Cl.[5] ..... B42D 3/00

[52] U.S. Cl. ..... 281/45; 281/51; 462/64; 206/554

[58] Field of Search ..... 281/45, 2, 12, 13, 42, 281/44, 51; 206/260, 554, 813; 462/21, 84, 900, 64

[56] References Cited

U.S. PATENT DOCUMENTS 4,228,900 10/1980 Lambach et al. ..... 206/260
4,557,384 12/1985 Membrino ..... 206/554
4,674,634 6/1987 Wilson ..... 206/554
4,690,280 9/1987 Meyer ..... 206/554
4,798,401 1/1989 Greig ..... 281/42

*Primary Examiner*—Timothy V. Eley
*Assistant Examiner*—Willmon Fridie, Jr.
*Attorney, Agent, or Firm*—Walter A. Hackler

[57] ABSTRACT

A combination note and article support device includes a paper sheet having a low-tack adhesive on one side thereof for adhesively securing the paper sheet to a surface and a pouch attached thereto for supporting an article. Another side of the paper sheet has a surface suitable for inscription by a marking device.

13 Claims, 2 Drawing Sheets

COMBINATION NOTE AND ARTICLE SUPPORT DEVICE AND METHOD

The use of repositionable paper note sheets has been become widespread. Such notes are typically provided in pad form which include a plurality of relatively small paper sheets with a low-tack adhesive disposed on one side of the sheets, thereby enabling individual paper note sheets to be removed from the pad and adhesively secured to another surface. This type of device and the adhesives utilized therein are now conventional and sold, for example, under the trade name of Post-It ® by 3-M Company of St. Paul, Minn. and under the name of Note Stix ®, manufactured and sold by Moore Business Forms, Inc., Grand Island, N.Y.

These note pads have become very popular because the low-tack adhesive used thereon enables the individual sheets to be removably positioned or adhesively secured to other surfaces.

While such note pads are particularly suited for conveying messages or notes inscribed thereon, they do not provide a means for conveying or temporarily adhering articles which may pertain to the message or note inscribed on the sheet.

There is a need for a combination note and article support device which can be used in the manner of an adhesive note sheet and further capable of supporting an article pertaining an inscription of the note sheet so that not only may a message but an article may be conveyed to another person or attached temporarily to a file or the like.

SUMMARY OF THE INVENTION

The present invention generally includes a paper sheet having a low-tack adhesive on one side thereof for adhesively securing the paper sheet to a surface. A surface on the opposite side of the paper sheet is suitable for inscription by a marking device. In combination therewith, pouch means are attached to the paper sheet for supporting an article. More particularly, a device in accordance with the present invention includes means defining an opening in the pouch for enabling articles to be removably disposed in the pouch means.

In one embodiment of the present invention, a pouch means further provides means for releasably sealing the pouch opening.

In order to provide a more stable support to the device, the pouch means is attached to the one side of the paper sheet. This attachment provides means for enabling one of a plurality of paper sheets to be adhesively secured to a second of a plurality of paper sheets in a position sealing the pouch means attached to an underlying paper sheet.

When the pouch means is sufficiently thin, a plurality of devices may be adhesively secured to one another in the form of a pad.

Accordingly, a combination note and article support system in accordance with the present invention includes a plurality of paper sheets, each comprising low-tack adhesive means on one side of each paper sheet for adhesively securing each paper sheet to a surface and a plurality of pouch means, each one attached to a paper sheet for removably holding an article.

A method in accordance with the present invention, which enables sequential access to a plurality of articles, generally includes the securing of a first paper sheet, having a pouch for supporting an article attached thereto, to a surface and thereafter securing at least a second paper sheet, having a pouch attached thereto, on the first paper sheet which becomes an underlying sheet.

Further, a method of the present invention may include the step of inscribing on each paper sheet information relating to an article disposed in the pouch attached to each paper sheet.

More particularly, when the second paper sheet is adhesively secured to the first paper sheet in the position sealing the pouch attached to the first paper sheet, access to the articles disposed within the pouches is inherently sequentially ordered in that when overlying paper sheets and pouches are removed from underlying paper sheets and pouches, sequential access to the articles is mandated.

In accordance with the method of the present invention, when the second paper sheet is adhesively adhered to the first paper sheet at a position enabling inscriptions made on both first and second paper sheets to be visible when the first and second sheets are attached to one another, identification of articles disposed in the adhered paper note pouches may be read and confirmed without disassembly of the adhered paper sheets and pouches.

This method, device and system are particularly useful for the ordering of medication which may need to be sequentially taken. That is, daily medications may be disposed in a pouch and the pouch contents recorded on the attached paper sheet which also may be numbered. Thereafter, the laying of the paper sheets and pouches with the medications contained in the individual pouches, as indicated by the attached sheets, enables a safe, orderly, dispensation of medications for those individuals having difficulty in keeping track of their medication schedule. Because the low-tack adhesive utilized in the present invention is suitable for attachment to any number of surfaces, the note and article support device consistent with the present invention may be utilized on a bed stand, bathroom mirror, or any other suitable surface.

BRIEF DESCRIPTION OF THE DRAWINGS

The advantages and features of the present invention will be better understood by the following description when considered in conjunction with the accompanying drawings in which.

DETAILED DESCRIPTION OF THE DRAWINGS

Figure 1:
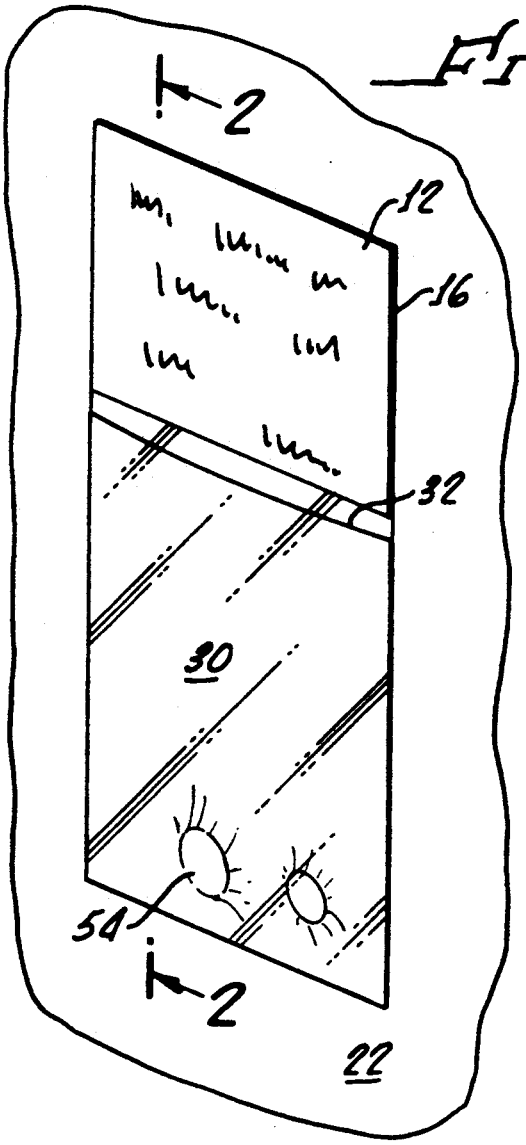
FIG. 1 is a perspective view of a combination note pad and pouch in accordance with the present invention generally showing a note sheet and a pouch attached thereto.
Figure 2:
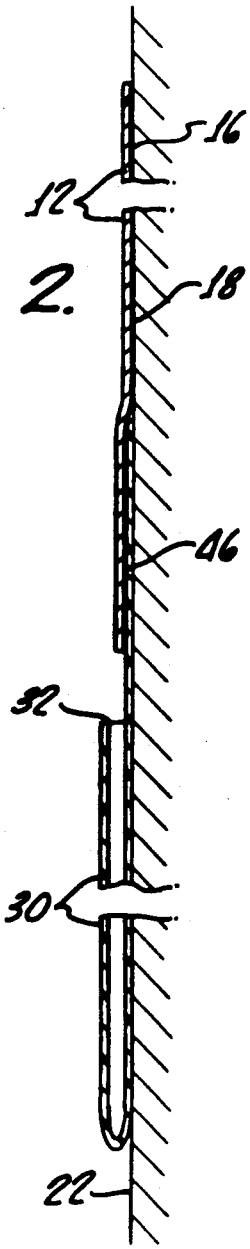
FIG. 2 is a cross-sectional view of the combination note pad and pouch in accordance with the present invention as positioned by a low-tack adhesive on a surface.

Turning now to FIGS. 1 and 2, there is shown a combination note and article support device, or note/-pouch, 10 shown in perspective, which generally includes a paper sheet 12 with a low-tack adhesive 16 disposed on one side 18 which provides a means for adhesively securing the paper sheet 12 to a surface 22.

It should be appreciated that the paper sheet 12 may be of any convenient size and consist of any suitable paper stock typically utilized in repositionable adhesive note sheets, such as Post-It® and Note Stix® brand note pads, hereinbefore discussed.

The low-tack adhesive 16 may be any suitable self-stick adhesive, such as, for example, that used on the above-referenced note pads.

The low-tack adhesive 16 may be applied on the one side 18 of the paper sheet 12 in a continuous strip as shown or in spot intervals as may be suitable and determined from simple experimentation.

The paper sheet 12 includes a surface on an opposite side which is suitable for inscription by any conventional marking device such as a pencil, ballpoint pen, or marker.

In combination with the paper sheet, a pouch 30 attached thereto provides means for suitable articles, such as, for example, a medication in form of a powder, pill or capsule.

Figure 3:
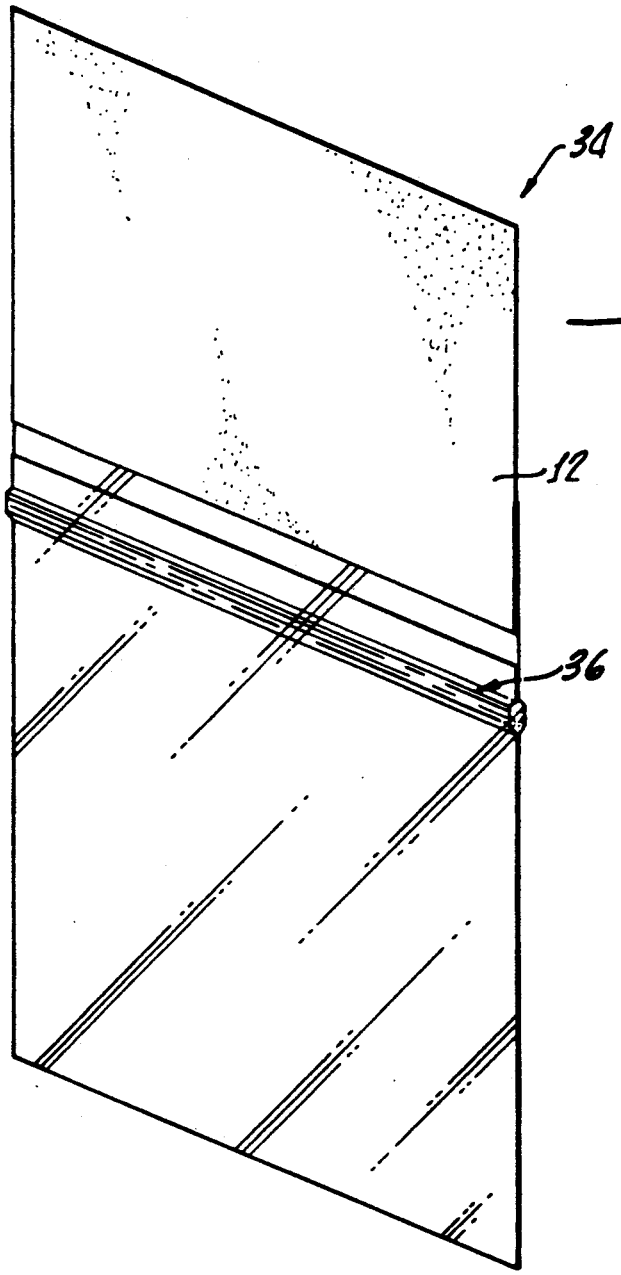
FIG. 3 is an alternative embodiment of the present invention showing a pouch have a zip-lock system for closing an opening therein.

Various sizes of a pouch 30 may be utilized as shown in FIG. 3 and utilized for any number of purposes such as, for example, supporting a cookie on a refrigerator for a child coming home from school, with an appropriate note written on the paper sheet 12.

An opening 32 in the pouch provides a means for enabling articles to be removably disposed in the pouch 30. In an alternative embodiment 34, of the present invention, a conventional zip-lock system 36, see FIG. 3, may be utilized, if desired.

Figure 4:
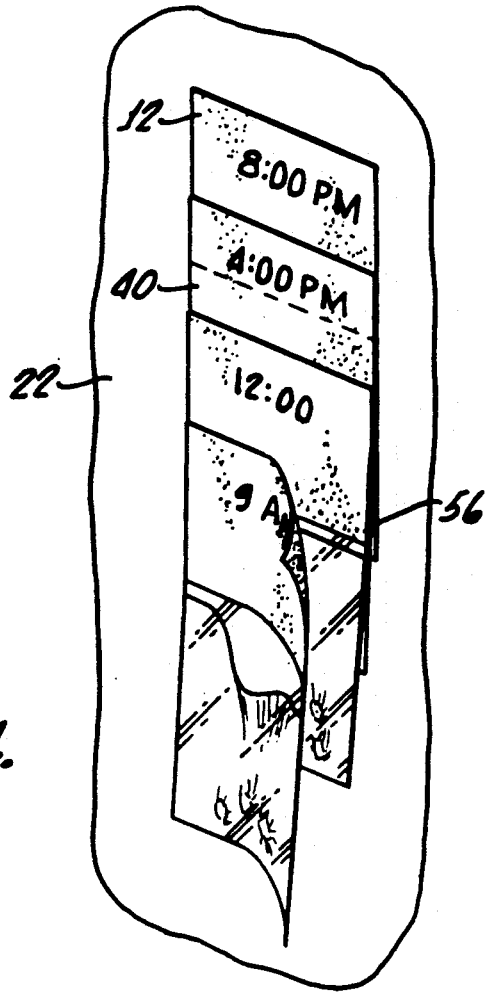
FIG. 4 is a perspective view of a plurality of note pad and pouches secured to one another in a manner in which overlying note pads seal openings in underlying pouches and displaying indicia on each note pad corresponding to contents of attached pouchs.

Alternatively, sealing of the opening 32 may be by a second paper sheet 40, as shown in FIG. 4 and hereinafter discussed.

In order to enable the second paper sheet 40 to be adhesively secured to the first paper sheet 10 in a position sealing the pouch opening 32, the pouch 30 is attached to the one side 18 of the paper sheet 12. This attachment may be by way of a permanent adhesive 46 which may be of any suitable type to prevent the pouch 30 from separating from the sheet 12 during the use of the sheet pouch lo and separation and repositioning of the note/sheet 12 on the surface 22.

Figure 5:
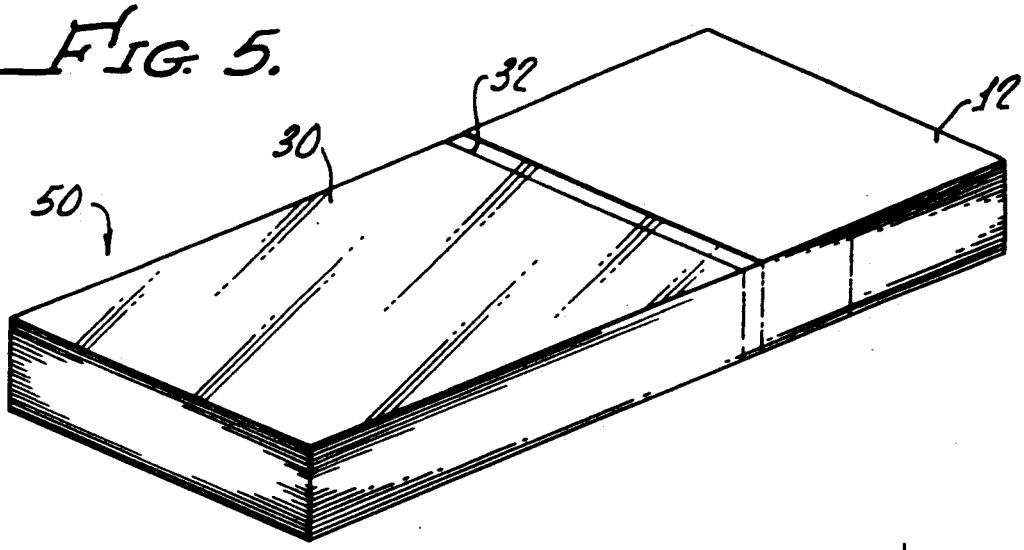
FIG. 5 is a perspective view of a plurality of note pad and pouches secured to one another in a manner forming a pad.

Preferably, the pouch 30 is configured from a suitable plastic material with a thickness for enabling the plurality of paper sheets 10 to be adhesively secured to one another in the form of a pad 50 as shown in FIG. 5.

Importantly, when the sheets 10 are made of sufficient size when the sheets 10 are attached to one another, as shown in FIG. 4, inscriptions made thereon are visible, thereby identifying the articles disposed in pouches 30 attached thereto, even though the pouches may be covered by overlying sheets.

The method of the present invention is particularly suitable for enabling sequential access to a plurality of articles, such as medications, as hereinabove noted.

The method therefore includes disposing a first paper sheet 12 having a pouch 30 for supporting an article, such as medication 54, to a surface 22 and thereafter securing at least a second paper sheet 40 having a pouch 56 attached thereto for supporting additional medication, on the first paper sheet as hereinabove described and shown in FIG. 4.

Additionally, the method may include the step of inscribing on each paper sheet information relating to the medication, such as the time of day for ingesting the medication or other instructions.

As shown in FIG. 4, the method in accordance with the present invention includes the securing of overlying paper sheets 40 to underlying sheets 12 in sealing the openings 32 therein and so positioned as shown in FIG. 4, with the inscriptions made on underlying and overlying sheets 12, 40 visible when the first and second sheets are adhesively attached to one another.

Although there has been hereinabove described a combination note and article support device and method in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A combination note and article support device comprising:

a paper sheet comprising low-tack adhesive means on one side of said paper sheet for adhesively securing said paper sheet to a surface, said paper sheet having a surface on an opposite side suitable for inscription by a marking device; and pouch means attached to said paper sheet for supporting an article.

2. The device according to claim 1 wherein said pouch means comprises means, defining an opening therein, for enabling articles to be removably disposed in said pouch means.

3. The device according to claim 2 wherein said pouch means comprises means for releasably sealing the pouch opening.

4. The device according to claim 1 wherein said pouch means is attached to said one side of the paper sheet.

5. The device according to claim 1 wherein the pouch means have a thickness for enabling a plurality of the devices to be adhesively secured to one another in the form of a pad.

6. A combination note and article support system comprising:

a plurality of paper sheets each comprising low-tack adhesive means, on one side of each paper sheet, for adhesively securing each paper sheet to a surface, each paper sheet having a surface on an opposite side suitable for inscription by a marking device; and a plurality of pouch means, one each attached to a paper sheet, for removably holding an article, said pouch means being attached to the paper sheets at positions enabling a first paper sheet to be attached to a second paper sheet at a position sealing the pouch means attached to the second paper sheet.

7. The system according to claim 6 wherein the means attaching a pouch means to a paper sheet comprises a permanent adhesive disposed on the one side of each paper sheet.

8. The system according to claim 7 wherein each pouch means comprises means for releasably sealing the pouch means.

9. The system according to claim 6 wherein each pouch means has a thickness enabling the plurality of paper sheets to be adhesively secured to one another in the form of a pad.

10. The system according to claim 6 wherein each paper sheet is of sufficient size to enable inscriptions made thereon to be visible when said first and second sheets are attached to one another.

11. A method of sequentially enabling access to a plurality of articles, said method comprising:

securing a first paper sheet, having a pouch for supporting an article, attached thereto, to a surface;

securing at least a second paper sheet, having a pouch, for supporting another article, attached thereto, onto said first paper sheet; and inscribing on each paper sheet information relating to the article disposed in the pouch attached to each paper sheet.

12. The method according to claim 11 wherein said second paper sheet is adhesively secured to said first paper sheet in a position sealing the pouch attached to the first paper sheet.

13. The method according to claim 11 wherein said second paper sheet is adhesively adhered to said first paper sheet at a position enabling inscription made on both said first and second paper sheets to be visible when the first and second paper sheets are adhered to one another.

* * * * *